US009457588B2

(12) United States Patent
Yoneta

(10) Patent No.: US 9,457,588 B2
(45) Date of Patent: Oct. 4, 2016

(54) THERMAL HEAD AND THERMAL PRINTER

(71) Applicant: KYOCERA Corporation, Kyoto-shi, Kyoto (JP)

(72) Inventor: Masashi Yoneta, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/770,321

(22) PCT Filed: Feb. 20, 2014

(86) PCT No.: PCT/JP2014/053993
§ 371 (c)(1),
(2) Date: Aug. 25, 2015

(87) PCT Pub. No.: WO2014/132870
PCT Pub. Date: Sep. 4, 2014

(65) Prior Publication Data

US 2016/0001573 A1 Jan. 7, 2016

(30) Foreign Application Priority Data

Feb. 27, 2013 (JP) ..... 2013-037397
Sep. 30, 2013 (JP) ..... 2013-204368

(51) Int. Cl.
*B41J 2/335* (2006.01)

(52) U.S. Cl.
CPC ..... *B41J 2/3358* (2013.01); *B41J 2/3351* (2013.01); *B41J 2/3353* (2013.01); *B41J 2/3354* (2013.01); *B41J 2/3357* (2013.01); *B41J 2/33525* (2013.01)

(58) Field of Classification Search
CPC .... B41J 2/335; B41J 2/33525; B41J 2/3354; B41J 2/3353; B41J 2/3358
See application file for complete search history.

(56) References Cited

U.S. PATENT DOCUMENTS 5,428,378 A * 6/1995 Murata ..... B41J 2/17566 347/19
2005/0140732 A1* 6/2005 Oikawa ..... B41J 2/14129 347/54

FOREIGN PATENT DOCUMENTS

JP 02-248257 A 10/1990
JP 2001-113741 A 4/2001
JP 2013-018131 A 1/2013

* cited by examiner

*Primary Examiner* — Sarah Al Hashimi
(74) *Attorney, Agent, or Firm* — Volpe and Koenig, P.C.

(57) ABSTRACT

A thermal head capable of efficiently radiating heat transferred to a protective member is provided. A thermal head includes a substrate; a plurality of heat generating portions disposed on the substrate; an electrode which is disposed on the substrate and is electrically connected to the heat generating portions; a conductive member electrically connected to the electrode; a protective member which is in contact with the conductive member and protects the conductive member; and a heatsink on an upper surface of which the substrate is disposed, wherein the protective member is also in contact with the heatsink.

20 Claims, 16 Drawing Sheets

THERMAL HEAD AND THERMAL PRINTER

TECHNICAL FIELD

The present invention relates to a thermal head and a thermal printer.

BACKGROUND ART

In the related art, as a printing device used in a facsimile, a video printer or the like, various thermal heads have been proposed. For example, there is known a thermal head including a substrate, a plurality of heat generating portions disposed on the substrate, an electrode which is disposed on the substrate and is electrically connected to the heat generating portions, a conductive member which electrically connects the electrode to an external device, and a protective member which is in contact with the conductive member and protects the conductive member (for example, see Patent Literature 1). Further, there is known a thermal head including a heatsink disposed under a substrate (for example, see Patent Literature 2).

CITATION LIST

Patent Literature

Patent Literature 1: Japanese Unexamined Patent Publication JP-A 02-248257 (1990)

Patent Literature 2: Japanese Unexamined Patent Publication JP-A 2001-113741

SUMMARY OF INVENTION

Technical Problem

However, in the above-described thermal heads, since the protective member is disposed on the conductive member, when heat is generated in the conductive member according to driving of the thermal head, it may be difficult to efficiently radiate heat transferred from the conductive member to the protective member.

Solution to Problem

A thermal head according to an embodiment of the invention includes: a substrate; a plurality of heat generating portions disposed on the substrate; an electrode which is disposed on the substrate and is electrically connected to the heat generating portions; a conductive member which electrically connects the electrode to an external device; a protective member which is in contact with the conductive member and protects the conductive member; and a heatsink disposed under the substrate. The protective member is also in contact with the heatsink.

A thermal printer according to another embodiment of the invention includes: the thermal head mentioned above; a conveyance mechanism which conveys a recording medium onto the heat generating portions; and a platen roller which presses the recording medium onto the heat generating portions.

Advantageous Effects of Invention

According to the invention, it is possible to efficiently radiate heat transferred to the protective member.

DESCRIPTION OF EMBODIMENTS

First Embodiment

Figure 1:
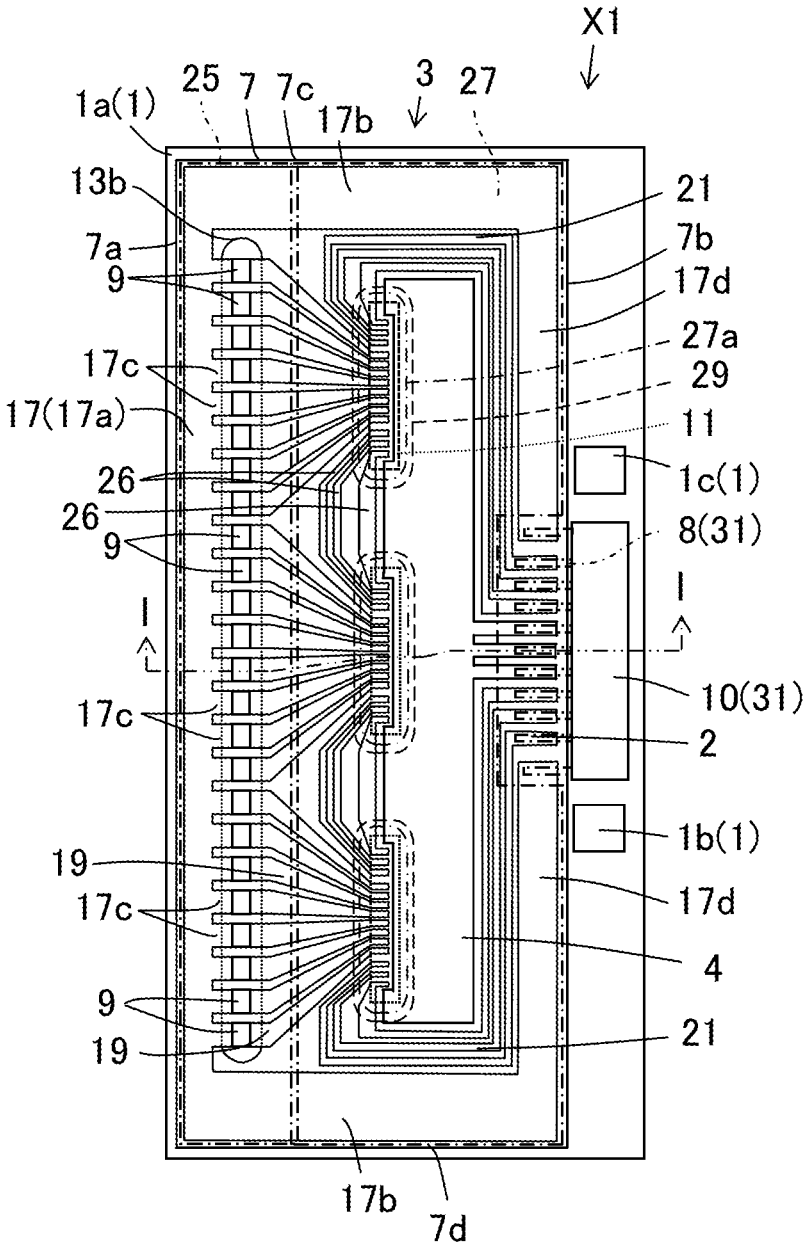
FIG. 1 is a plan view illustrating a thermal head according to a first embodiment of the invention.

Hereinafter, a thermal head X1 according to a first embodiment will be described with reference to FIGS. 1 to 3. In FIG. 1, a protective member 12 is not shown.

The thermal head X1 includes a heatsink 1, a head base 3 that is disposed on the heatsink 1, and a connector 31 that is connected to the head base 3. In the thermal head X1, a configuration in which the connector 31 electrically connected to a conductive member 23 is used as a member for electric connection to an external device is described, but the invention is not limited thereto. For example, a flexible printed wiring board having flexibility may be used as the conductive member 23.

The heatsink 1 includes a base portion 1*a*, a first convex portion 1*b*, and a second convex portion 1*c*. The base portion 1*a* of the heatsink 1 is formed in a plate shape, and has a rectangular shape in a plan view. The first convex portion 1*b* and the second convex portion 1*c* are disposed on the base portion 1*a* apart from each other at a predetermined interval. The first convex portion 1*b* protrudes upwardly from the base portion 1*a*, and has a rectangular shape in a plan view and has a rectangular shape in a side view. The second convex portion 1*c* protrudes upwardly from the base portion 1*a*, and has a rectangular shape in a plan view and has a rectangular shape in a side view. That is, the first convex portion 1*b* and the second convex portion 1*c* have a cubic shape.

The heatsink 1 is formed of a metallic material such as copper, iron or aluminum, for example, and has a function of radiating heat that does not contribute to printing, from heat generated in a heat generating portion 9 of the head base 3. Further, the head base 3 is adhered to an upper surface of the base 1*a* through a double-sided tape, an adhesive or the like (not shown).

The head base 3 is formed in a rectangular shape in a plan view. Respective members that form the thermal head X1 are disposed on a substrate 7 of the head base 3. The head base 3 has a function of performing printing with respect to a recording medium (not shown) according to an electric signal supplied from the outside.

Figure 2:
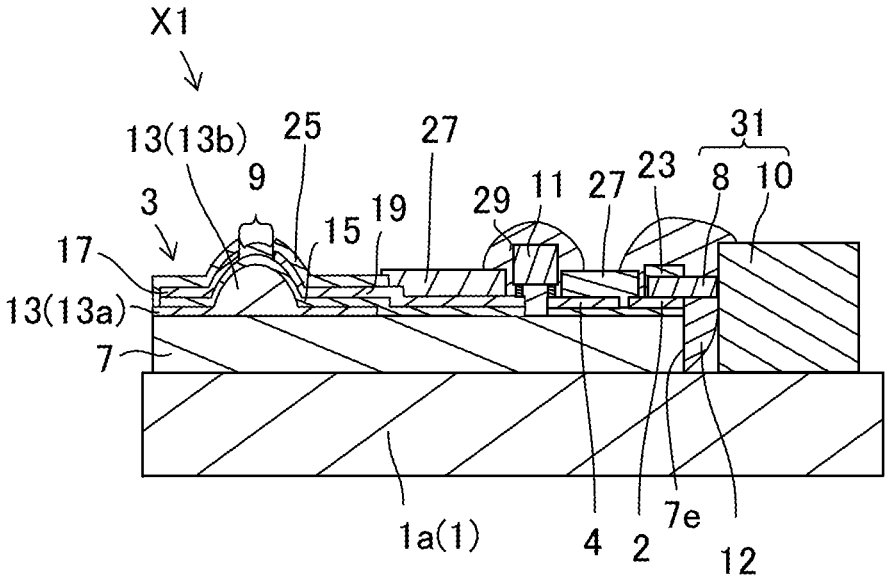
FIG. 2 is a sectional view taken along the line I-I shown in FIG. 1.

As shown in FIGS. 1 and 2, the connector 31 includes plural connector pins 8, and an accommodating portion 10 that accommodates the plural connector pins 8. A part of each of the connector pins 8 is exposed outside the accommodating portion 10, and the remaining part thereof is accommodated inside the accommodating portion 10. The plural connector pins 8 have a function of securing electric conduction between various electrodes of the head base 3 and an external power source, for example. The plural connector pins 8 are electrically independent of each other.

The accommodating portion 10 has a function of accommodating the respective connector pins 8 in a state of being electrically independent of each other. An external connector (not shown) is attached to or detached from the accommodating portion 10.

The connector pins 8 is required to have electric conductivity, and thus, may be formed of metal or alloy. The accommodating portion 10 may be formed by an insulating member, and for example, may be formed of a thermosetting resin, an ultraviolet curable resin, or a photo-curable resin. It is preferable that such a resin has high heat conductivity. Further, the respective connector pins 8 may be electrically independent of each other, and thus, when each connector pin 8 is accommodated through an insulating member, the accommodating portion 10 may be formed by a conductive member. As the conductive member, metal such as aluminum, gold, copper or iron, or alloy may be used.

Hereinafter, respective members forming the head base 3 will be described.

The substrate 7 is disposed on the base portion 1*a* of the heatsink 1, and has a rectangular shape in a plan view. Thus, the substrate 7 includes one long side 7*a*, the other long side 7*b*, one short side 7*c*, and the other short side 7*d*. Further, the substrate 7 includes a side surface 7*e* on a side of the other long side 7*b*. For example, the substrate 7 may be formed of an electrically insulating material such as alumina ceramics, a semiconductor material such as single crystal silicon, or the like.

A heat storage layer 13 is formed on an upper surface of the substrate 7. The heat storage layer 13 includes a base portion 13*a* and a protruding portion 13*b*. The base portion 13*a* is formed over a left half part of the upper surface of the substrate 7. The protruding portion 13*b* extends in a belt shape along an arrangement direction of the plural heat generating portions 9 (hereinafter, may be referred to as an arrangement direction), and has a cross section of a semi-elliptical shape. The base portion 13*a* is disposed in the vicinity of the heat generating portions 9, and is disposed below a protective layer 25 (which will be described later). The protruding portion 13*b* has a function of reliably bringing a recording medium for printing into pressure contact with the protective layer 25 formed on the heat generating portions 9.

The heat storage layer 13 is formed of glass having low heat conductivity and temporarily accumulates some of the heat generated from the heat generating portions 9, to thereby make it possible to shorten the amount of time necessary for increasing the temperature of the heat generating portions 9. Thus, the heat storage layer 13 has a function of enhancing a thermal response characteristic of the thermal head X1. The heat storage layer 13 may be formed, for example, by covering the upper surface of the substrate 7 with a predetermined glass paste obtained by mixing a suitable organic solvent into glass powder using screen printing or the like known in the art, and firing the resultant.

An electrical resistance layer 15 is disposed on an upper surface of the heat storage layer 13. Further, connection terminals 2, a ground electrode 4, a common electrode 17, individual electrodes 19, IC-connector connection electrodes 21, and IC-IC connection electrodes 26 are disposed on the electrical resistance layer 15. The electrical resistance layer 15 is patterned to have a shape corresponding to the connection terminals 2, the ground electrode 4, the common electrode 17, the individual electrodes 19, the IC-connector connection electrodes 21, and the IC-IC connection electrodes 26, and includes exposure areas through which the electrical resistance layer 15 is exposed between the common electrode 17 and the individual electrodes 19. As shown in FIG. 1, the exposure areas of the electrical resistance layer 15 are arranged on the protruding portion 13*b* of the heat storage layer 13 in a column shape. Further, the heat generating portions 9 are formed by the respective exposure areas.

Although simply shown in FIG. 1 for ease of description, the plural heat generating portions 9 may be disposed with a density of 100 dpi (dots per inch) to 2400 dpi, or the like, for example. The electrical resistance layer 15 is formed by a material having relatively high electric resistance, such as a TaN based material, a TaSiO based material, a TaSiNO based material, a TiSiO based material, a TiSiCO based material, or an NbSiO based material, for example. Thus, when voltage is applied to the heat generating portions 9, the heat generating portions 9 generate heat according to Joule heating.

As shown in FIGS. 1 and 2, the connection terminals 2, the ground electrode 4, the common electrode 17, the individual electrodes 19, the IC-connector connection electrodes 21, and the IC-IC connection electrodes 26 are disposed on an upper surface of the electrical resistance layer 15. The connection terminals 2, the ground electrode 4, the common electrode 17, the individual electrodes 19, the IC-connector connection electrodes 21, and the IC-IC connection electrodes 26 are formed of a conductive material, and for example, are formed of any one type of metal among aluminum, gold, silver and copper, or alloy thereof.

The common electrode 17 includes main wiring portions 17*a* and 17*d*, a sub wiring portion 17*b*, and lead portions 17*c*. The main wiring portion 17*a* extends along one long side 7*a* of the substrate 7. The sub wiring portion 17*b* extends along each of one short side 7*c* and the other short side 7*d* of the substrate 7. The lead portions 17*c* individually extend from the main wiring portion 17*a* toward the respective heat generating portions 9. The main wiring portion 17*d* extends along the other long side 7*b* of the substrate 7.

The common electrode 17 is connected to the plural heat generating portions 9 in one end part thereof, and is connected to the connector 31 in the other end part thereof, so that the connector 31 and the respective heat generating portions 9 are electrically connected to each other. In order to reduce an electric resistance value of the main wiring portion 17*a*, the main wiring portion 17*a* may be formed as a thick electrode portion (not shown) having a thickness greater than those of the other portions of the common electrode 17.

The plural individual electrodes 19 are connected to the heat generating portions 9 in one end part thereof, and are connected to a drive IC 11 in the other end part thereof, so that the respective heat generating portions 9 and the drive IC 11 are electrically connected to each other. Further, the plural heat generating portions 9 are divided into plural groups, and the heat generating portions 9 in each group are electrically connected to the drive IC 11 provided corresponding to each group by the individual electrodes 19.

The plural IC-connector connection electrodes 21 are connected to the drive IC 11 in one end part thereof, and are connected to the connection terminals 2 extracted on a side of the other long side 7*b* of the substrate 7 in the other end part thereof. Thus, the IC-connector connection electrodes 21 are connected to the connector 31, so that the drive IC 11 and the connector 31 are electrically connected to each other. The plural IC-connector connection electrodes 21 connected to each drive IC 11 are formed by plural wirings having different functions.

The ground electrode 4 is disposed to be surrounded by the individual electrodes 19, the IC-connector connection electrodes 21, and the main wiring portion 17*d* of the common electrode 17, and has a wide area in a plan view. The ground electrode 4 is maintained at a ground electrode of 0 to 1 V.

The connection terminals 2 are extracted toward the other long side 7*b* of the substrate 7 to connect the common electrode 17, the individual electrodes 19, the IC-connector connection electrodes 21, and the ground electrode 4 to the connector 31. The connection terminals 2 are provided corresponding to the connector pins 8, and the connector pins 8 and the connection terminals 2 are connected to each other so as to be electrically independent.

The plural IC-IC connection electrodes 26 electrically connect the adjacent drive ICs 11. The plural IC-IC connection electrodes 26 are respectively provided corresponding to the IC-connector connection electrodes 21, and transmit various signals to the adjacent drive ICs 11.

As shown in FIG. 1, the drive IC 11 is disposed to correspond to each group of the plural heat generating portions 9, and is connected to the other portion of the individual electrodes 19 and one end portion of the IC-connector connection electrodes 21. The drive IC 11 has a function of controlling an electric conduction state of each heat generating portion 9. As the drive IC 11, a switching member provided with plural switching elements therein may be used.

The electrical resistance layer 15, the connection terminal 2, the common electrode 17, the individual electrodes 19, the ground electrode 4, the IC-connector connection electrodes 21, and the IC-IC connection electrodes 26 are formed by sequentially layering material layers that form the respective components on the heat storage layer 13 by a known thin film formation technique in the related art such as a sputtering method, and then, by processing the layered body into a predetermined pattern using a known photo-etching technique in the related art, for example. The connection terminal 2, the common electrode 17, the individual electrodes 19, the ground electrode 4, the IC-connector connection electrodes 21, and the IC-IC connection electrodes 26 may be formed by the same process at the same time.

As shown in FIGS. 1 and 2, the heat generating portions 9, and the heat protective layer 25 that cover a part of the common electrode 17 and a part of each individual electrode 19 are formed on the heat storage layer 13 formed on the upper surface of the substrate 7. In FIG. 1, for ease of description, a region where the protective layer 25 is formed is indicated by a single dot chain line.

The protective layer 25 has a function of protecting a region where the heat generating portions 9, the common electrode 17 and the individual electrodes 19 are covered from corrosion due to attachment of moisture included in the air or abrasion due to contact with a recording medium for printing. The protective layer 25 may be formed using SiN, $SiO_2$, SiON, SiC, SiCN, diamond-like carbon, or the like. The protective layer 25 may be formed as a single layer, or may be formed as a multi-layer. Such a protective layer 25 may be manufactured using a thin film formation technique such as a sputtering method or a thick film formation technique such as a screen printing method.

Further, as shown in FIGS. 1 and 2, a cover layer 27 that partially covers the common electrode 17, the individual electrodes 19, and the IC-connector connection electrodes 21 is disposed on the substrate 7. In FIG. 1, for ease of description, a region where the cover layer 27 is formed is indicated by a single dot chain line.

The cover layer 27 has a function of protecting a region where the common electrode 17, the individual electrodes 19, and the IC-IC connection electrodes 26 and the IC-connector connection electrodes 21 are covered from oxidation due to contact with the air or corrosion due to attachment of moisture or the like included in the air. In order to ensure protection of the common electrode 17 and the individual electrode 19, it is preferable that the cover layer 27 is formed to overlap an end portion of the protective layer 25, as shown in FIG. 2. The cover layer 27 may by formed of a resin material such as epoxy resin or polyimide resin using a thick film formation technique such as a screen printing method, for example.

The cover layer 27 is formed with opening portions 27*a* through which the individual electrodes 19 connected to the drive ICs 11, the IC-IC connection electrodes 26 and the IC-connector connection electrodes 21 are exposed, and wirings thereof are connected to the drive ICs 11 through the opening portions 27*a*. Further, the drive IC 11 is sealed by being covered with a covering member 29 formed of resin such as epoxy resin or silicone resin.

Electric connection between the connector 31 and the head base 3 and connection between the protective member 12 and the heatsink 1 will be described with reference to FIGS. 2 and 3.

Figure 3:
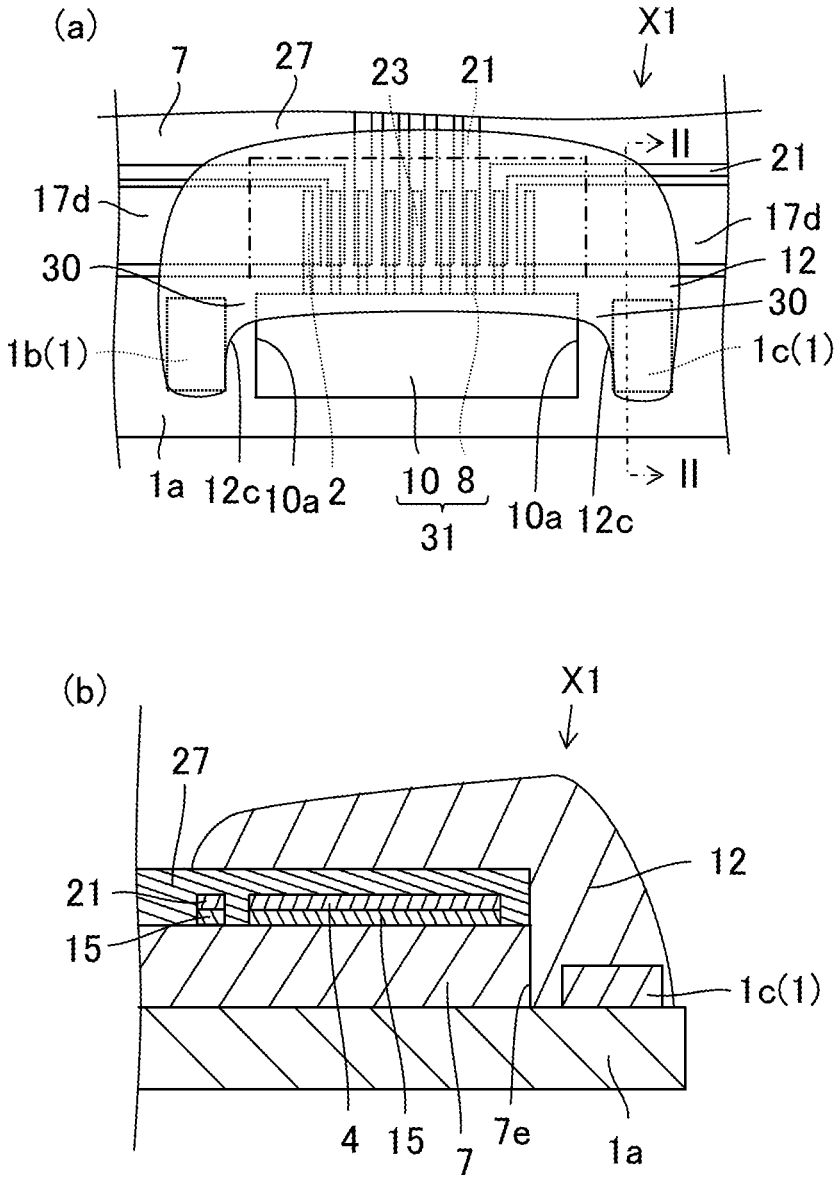
FIG. 3(*a*) is an enlarged plan view illustrating a connector and its periphery of the thermal head shown in FIG. 1, and FIG. 3(*b*) is a sectional view taken along the line II-II shown in FIG. 3(*a*)

As shown in FIG. 3(*a*), the connector pins 8 are disposed on the connection terminals 2 of the ground electrode 4 and the connection terminals 2 of the IC-connector connection electrode 21. As shown in FIG. 2, each connection terminal 2 and each connector pin 8 are electrically connected to each other by each conductive member 23.

The conductive member 23 may be formed, for example, using solder, an anisotropic conductive adhesive in which conductive particles are mixed in an electric insulating resin, or the like. The present embodiment in which solder is used will be described. The connector pin 8 is covered by the conductive member 23 to be electrically connected to the connection terminal 2. A plating layer (not shown) made of Ni, Au or Pd may be disposed in a space between the conductive member 23 and the connection terminal 2.

The connectors 31 are disposed so that the accommodating portion 10 is spaced from the side surface 7*e* of the substrate 7 at a predetermined interval. Further, the accommodating portion 10 is disposed on the base portion 1*a* of the heatsink 1, and is fixed by a bonding material (not shown) such as an adhesive or a double-sided tape. In the connector 31, the accommodating portion 10 may be spaced from the base portion 1*a* of the heatsink 1 at a predetermined interval, or the accommodating portion 10 may not be bonded to the base portion 1*a* through the bonding material.

As shown in FIG. 3, the heatsink 1 includes the first convex portion 1*b* and the second convex portion 1*c* on the base portion 1*a*. The first convex portion 1*b* and the second convex portion 1*c* protrude upwardly, and are disposed in an arrangement direction at a predetermined interval. The accommodating portion 10 is disposed between the first convex portion 1*b* and the second convex portion 1*c*.

The first convex portion 1*b* and the second convex portion 1*c* are formed integrally with the heatsink 1 by embossing, or may be manufactured by bonding a member separately formed from the base portion 1*a* to the base portion 1*a*. Further, the first convex portion 1*b* and the second convex portion 1*c* may be formed by bending a part of the base portion 1*a* to protrude upwardly. In addition, the first convex portion 1*b* and the second convex portion 1*c* may be formed in a rectangular shape, a circular shape, or a semicircular shape, in a plan view.

The protective member 12 may be disposed so as to cover the conductive members 23 and the connector pins 8 in order to protect the conductive members 23. In the present embodiment, the protective member 12 is disposed over an entire region of the conductive members 23 and the connector pins 8 to seal the conductive members 23 and the connector pins 8.

Further, a part of the protective member 12 is disposed from upper parts of the conductive members 23 to the heatsink 1, so that the protective member 12 is in contact with the heatsink 1. That is, the conductive members 23 and the heatsink 1 are thermally connected to each other by the integrated protective member 12.

Here, when the thermal head X1 is driven, an electric signal is transmitted to the head base 3 through the conductive member 23 from the outside, and the thermal head X1 drives the heat generating portion 9 to generate heat based on the electric signal. The temperature of the conductive member 23 may increase due to contact resistance or wiring resistance during electric conduction. Thus, the temperature of the protective member 12 disposed so as to be in contact with the conductive member 23 also increases. Here, when heat radiation of the protective member 12 is not efficiently performed, heat is accumulated in the protective member 12 to soften the protective member 12, and thus, a bonding strength of the protective member 12 may be reduced.

However, the thermal head X1 has a configuration in which the protective member 12 disposed on the conductive members 23 is in contact with the heatsink 1. Thus, the heat generated by the conductive members 23 is radiated to the heatsink 1 through the protective member 12, so that the heat of the protective member 12 can be efficiently radiated. As a result, it is possible to reduce a possibility that the protective member 12 is softened, and to reduce a possibility that the bonding strength of the protective member 12 and the substrate 7 is reduced.

Further, the protective member 12 extends from the conductive members 23 to an upper surface of the first convex portion 1*b* and an upper surface of the second convex portion 1*c*. That is, the conductive members 23 are in contact with the first convex portion 1*b* and the second convex portion 1*c* through the protective member 12. Further, since the first convex portion 1*b* and the second convex portion 1*c* protrude upwardly from the base portion 1*a*, it is possible to shorten a distance from the conductive members 23 to the heatsink 1 by a protruding length of the first convex portion 1*b* and the second convex portion 1*c*. Thus, it is possible to easily radiate the heat generated in the conductive members 23. Further, since the protective member 12 is formed in a dam structure by the first convex portion 1*b* and the second convex portion 1*c*, it is possible to reduce the amount of the protective member 12 that forms the thermal head X1, and to reduce the manufacturing cost of the thermal head X1.

Since it is sufficient that the protective member 12 is in contact with the first convex portion 1*b* and the second convex portion 1*c*, the protective member 12 may not be disposed on the upper surfaces of the first convex portion 1*b* and the second convex portion 1*c*. For example, even in a case where the protective member 12 is in contact with side surfaces of the first convex portion 1*b* and the second convex portion 1*c*, it is possible to efficiently radiate the heat transferred to the protective member 12.

The thermal head X1 has a configuration in which the accommodating portion 10 is disposed between the first convex portion 1*b* and the second convex portion 1*c* and the protective member 12 is disposed between the first convex portion 1*b* and the accommodating portion 10 and between the second convex portion 1*c* and the accommodating portion 10 in a plan view. Thus, it is possible to radiate the heat of the conductive members 23 to the first convex portion 1*b* and the second convex portion 1*c* through the protective member 12, to increase the bonding area between the protective member 12, and the connector 31 and the heatsink 1, and to increase the bonding strength between the protective member 12, and the connector 31 and the heatsink 1.

Further, the protective member 12 is also disposed between the side surface 7*e* of the substrate 7, and the first convex portion 1*b* and the second convex portion 1*c*. Thus, it is possible to increase the bonding area between the protective member 12, and the substrate 7 and the heatsink 1, and to increase the bonding strength of the protective member 12.

The protective member 12 protects electric conduction by covering the conductive members 23 and the connector pins 8, but as shown in FIG. 2, it is preferable that the protective member 12 is also disposed in a part of the upper surface of the accommodating portion 10. Thus, it is possible to cover the entire area of the connector pins 8 by the protective member 12, and to protect the electric conduction.

Further, as shown in FIG. 2, it is preferable that the protective member 12 is also disposed between the accommodating portion 10 and the side surface 7*e* of the substrate 7. Thus, it is possible to increase the bonding strength of the substrate 7 in the thickness direction by the protective member 12 disposed on the upper surface of the connector 31, and even though a rotation moment is generated in the connector 31 when a connector (not shown) is inserted from the outside, it is possible to reduce a possibility that the connector 31 is separated.

Further, it is possible to increase the bonding strength in a direction where the connector pins 8 extend by the protective member 12 disposed between the accommodating portion 10 and the side surface 7*e* of the substrate 7. Thus, it is possible to further increase the bonding strength between the substrate 7 and the connector 31. Particularly, by disposing the protective member 12 on a part of the upper surface of the accommodating portion 10, it is possible to enhance the bonding strength of the upper surface of the accommodating portion 10. A configuration in which the side surface 7*e* of the substrate 7 and the accommodating portion 10 are in contact with each other without providing a gap between the side surface 7*e* of the substrate 7 and the accommodating portion 10 may be used.

Further, as shown in FIG. 3(*a*), it is preferable that the protective member 12 is also disposed in a region 30 interposed between a side surface 10*a* of the accommodating portion 10 of the connector 31, the side surface 7*e* of the substrate 7, and the first convex portion 1*b* and the second convex portion 1*c*. Thus, it is possible to radiate the heat of the conductive member 23 to the heatsink 1 through the protective member 12 disposed in the region 30.

Further, as the protective member 12 is disposed in the region 30, it is possible to firmly fix the accommodating portion 10 to the substrate 7. That is, when an external force in the arrangement direction of the heat generating portions 9 acts on the accommodating portion 10, the protective member 12 disposed in the region 30 can alleviate the external force.

Further, as shown in FIG. 3(*a*), it is preferable that a side surface 12*c* of the protective member 12 disposed in the region 30 has a convex shape toward the side surface 7*e* of the substrate 7 and the side surface 10*a* of the accommodating portion 10 in a plan view. Thus, it is possible to firmly fix the connector 31 against external force in the arrangement direction.

The protective member 12 may be formed of an epoxy based thermosetting resin, an ultraviolet curable resin, or a photo-curable resin, for example. It is preferable that the protective member 12 is formed of a resin member with a high heat radiation property (hereinafter, referred to as a heat radiation member).

As the heat radiation member, for example, an organic resin such as epoxy may be used. In order to enhance thermal conductivity, fillers or a filling material may be contained in the organic resin. Specifically, a heat radiation member in which heat conductive fillers are contained in a high molecular polymer may be used. It is preferable that the thermal conductivity of the heat radiation member is 0.8 to 4.0 (W/m·K).

In the case of the above-described heat radiation member in which the heat conductive fillers are contained in the high molecular polymer, the thermal conductivity becomes 3.0 (W/m·K), so that the thermal conductivity of the protective member 12 can be increased. This thermal conductivity is higher than a thermal conductivity of air (0.024 (W/m·K)), and thus, it is possible to efficiently radiate the heat of the conductive member 23.

In the thermal head X1, an example in which the protective member 12 is disposed between the first convex portion 1*b* and the accommodating portion 10 and between the second convex portion 1*c* and the accommodating portion 10 is shown, but the protective member 12 may be disposed only between the first convex portion 1*b* and the accommodating portion 10, or only between the second convex portion 1*c* and the accommodating portion 10. Further, an example in which solder is used as the conductive member 23 is shown, but an anisotropic conductive adhesive may be used.

Next, a thermal printer Z1 will be described with reference to FIG. 4.

Figure 4:
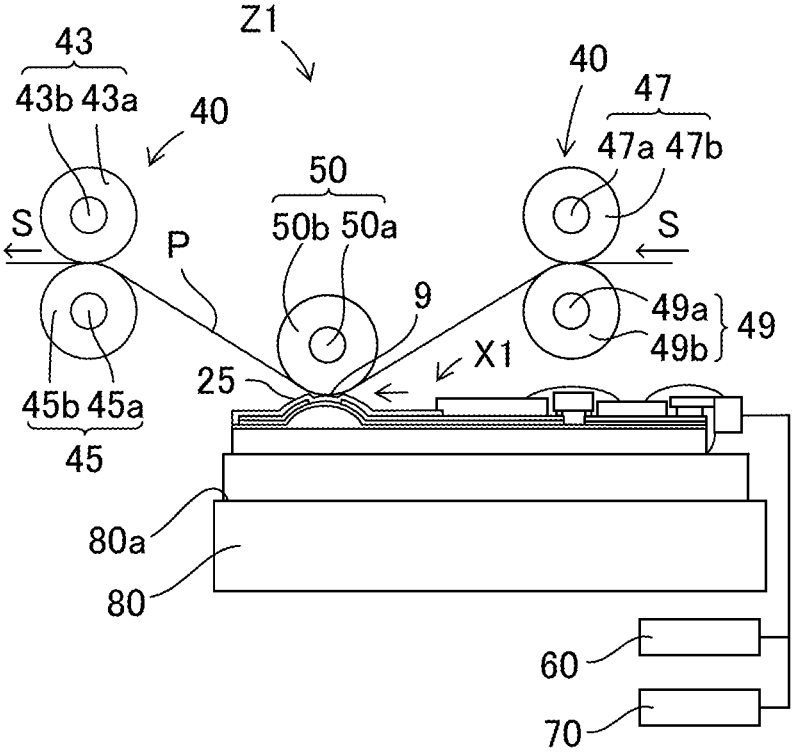
FIG. 4 is a diagram illustrating a schematic configuration of an embodiment of a thermal printer according to the first embodiment of the invention.

As shown in FIG. 4, the thermal printer Z1 of the present embodiment includes the above-described thermal head X1, a conveyance mechanism 40, a platen roller 50, a power source device 60, and a control device 70. The thermal head X1 is attached to an installation surface 80*a* of an installation member 80 disposed in a housing (not shown) of the thermal printer Z1. The thermal head X1 is installed to the installation member 80 so that the arrangement direction of the heat generating portions 9 follows a main scanning direction which is a direction orthogonal to a conveyance direction S of a recording medium P which will be described later.

The conveyance mechanism 40 includes a drive unit (not shown), and conveying rollers 43, 45, 47, and 49. The conveyance mechanism 40 conveys the recording medium P such as a heat-sensitive paper or an image receiving paper on which ink is transferred in an arrow S direction in FIG. 4 to be conveyed onto the protective layer 25 disposed on the plural heat generating portions 9 of the thermal head X1. The drive unit has a function of driving the conveying rollers 43, 45, 47, and 49, and for example, may be configured using a motor. The conveying rollers 43, 45, 47, and 49 may be configured by covering cylindrical shafts 43*a*, 45*a*, 47*a*, and 49*a* formed of metal such as stainless steel with elastic members 43*b*, 45*b*, 47*b*, and 49*b* formed of butadiene rubber or the like. Although not shown, when the recording medium P is the image receiving paper or the like on which ink is transferred, an ink film is conveyed together with the recording medium P to between the recording medium P and the heat generating portions 9 of the thermal head X1.

The platen roller 50 has a function of pressing the recording medium P on the protective film 25 disposed on the heat generating portions 9 of the thermal head X1. The platen roller 50 is disposed to extend along the direction orthogonal to the conveyance direction S of the recording medium P, and opposite end portions of the platen roller 50 are fixedly supported to be rotatable in a state of pressing the recording medium P on the heat generating portions 9. The platen roller 50 may be configured by covering a cylindrical shaft 50*a* formed of metal such as stainless steel with an elastic member 50*b* formed of butadiene rubber or the like.

The power source device 60 has a function of supplying an electric current for heating the heat generating portions 9 of the thermal head X1 and an electric current for operating the drive IC 11 as described above. The control device 70 has a function of supplying a control signal for controlling the operation of the drive IC 11 to the drive IC 11 in order to selectively heat the heat generating portions 9 of the thermal head X1 as described above.

As shown in FIG. 4, in the thermal printer Z1, the recording medium P is conveyed onto the heat generating portions 9 by the conveyance mechanism 40 while being pressed on the heat generating portions 9 of the thermal head X1 by the platen roller 50, and the heat generating portions 9 are selectively heated by the power source device 60 and the control device 70, to thereby perform predetermined printing on the recording medium P. When the recording medium P is the image receiving paper or the like, ink of the ink film (not shown) conveyed together with the recording medium P is thermally transferred onto the recording medium P, to thereby perform printing on the recording medium P.

Second Embodiment

A thermal head X2 according to a second embodiment will be described with reference to FIG. 5. The same reference numerals are given to the same members, and description thereof will not be repeated.

In the thermal head X2, the accommodating portion 10 is disposed above the heatsink 1. The accommodating portion 10 is spaced from the base portion 1*a* of the heatsink 1 at a predetermined interval, and a gap 32 is formed between the accommodating portion 10 and the base portion 1*a*. Further, the protective member 12 is disposed in the gap 32.

Figure 5:
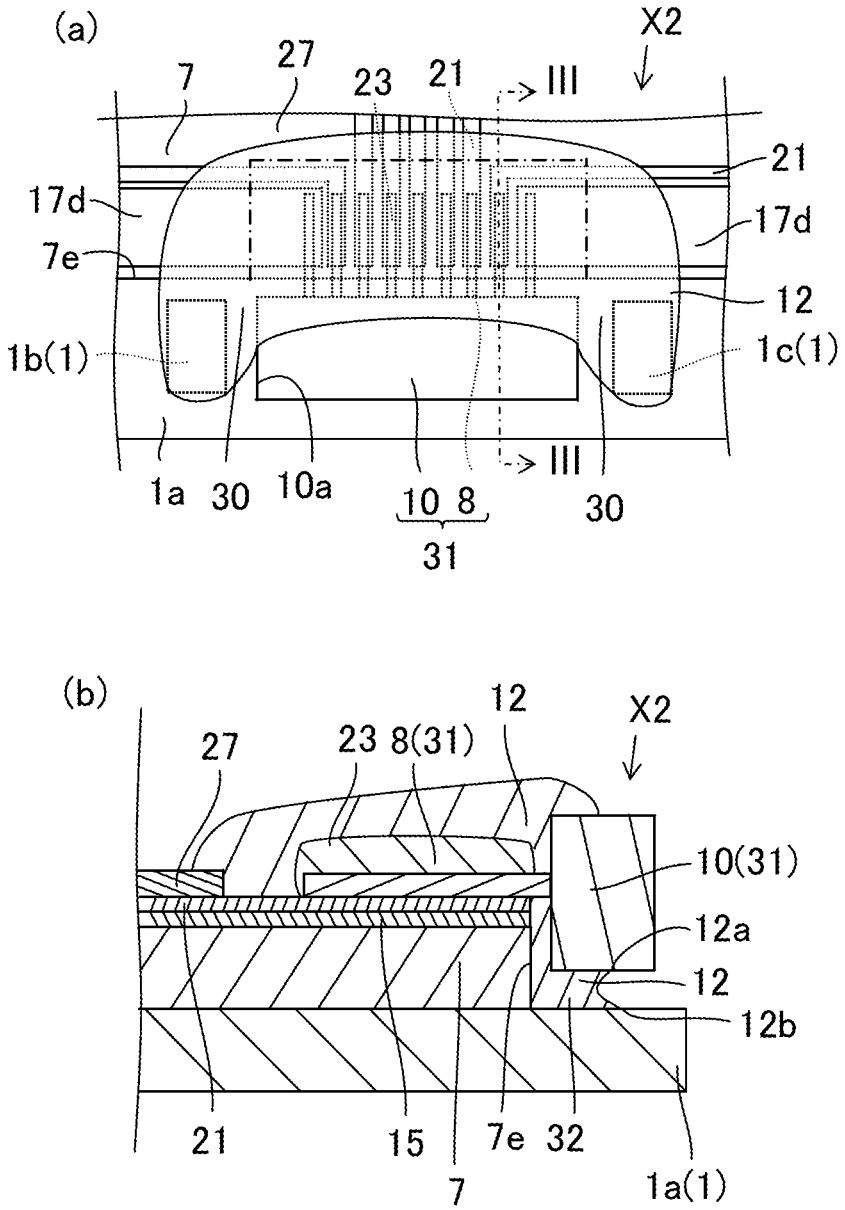
FIG. 5 is a diagram illustrating a thermal head according to a second embodiment of the invention, in which FIG. 5(*a*) is an enlarged plan view illustrating a connector and its periphery, and FIG. 5(*b*) is a sectional view taken along the line III-III shown in FIG. 5(*a*)

Thus, as shown in FIG. 5(*a*), the protective member 12 is disposed above the conductive members 23, the connector pins 8, the first convex portion 1*b*, the second convex portion 1*c*, and the accommodating portion 10. Further, the protective member 12 is disposed between the first convex portion 1*b* and the second convex portion 1*c*, and the side surface 7*e* of the substrate 7. Further, the protective member 12 is disposed between the side surface 10*a* of the accommodating portion 10, the first convex portion 1*b* and the second convex portion 1*c*, and the side surface 7*e* of the substrate 7.

Further, as shown in FIG. 5(*b*), the protective member 12 is disposed in the gap 32 between the base portion 1*a* of the heatsink 1 and the accommodating portion 10. Thus, when heat generated by the conductive member 23 is transferred to the accommodating portion 10 through the connector pins 8, it is possible to radiate the heat radiated in the accommodating portion 10 to the heatsink 1 by the productive member 12 disposed in the gap 32.

Further, as the protective member 12 is disposed in the gap 32, the protective member 12 fixes the upper surface and the lower surface of the accommodating portion 10, and thus, it is possible to further increase the bonding strength of the accommodating portion 10.

As shown in FIG. 5(*b*), the protective member 12 disposed in the gap 32 includes an upper end 12*a* and a lower end 12*b*. The protective member 12 is in contact with the accommodating portion 10 through the upper end 12*a*, and is in contact with the base portion 1*a* through the lower end 12*b*. Further, a portion disposed between the upper end 12*a* and the lower end 12*b* is disposed on the side surface 7*e* side of the substrate 7 with reference to the upper end 12*a* and the lower end 12*b*. In other words, an edge of the protective member 12 is formed in a shape in which a central part thereof in the thickness direction protrudes toward the side surface 7*e* of the substrate 7 in a sectional view.

Thus, it is possible to firmly fix the accommodating portion 10 in the thickness direction of the substrate 7, and even though a connector (not shown) is inserted into and extracted from the connector 31 from outside, it is possible to reduce a possibility that the accommodating portion 10 is separated from the substrate 7.

Further, an upper surface of the first convex portion 1*b* and an upper surface of the second convex portion 1*c* may be inclined so that the protective member 12 can be easily disposed in the space 30. That is, the upper surfaces of the first convex portion 1*b* and the second convex portion 1*c* may be lowered in height toward the accommodating portion 10. Thus, the upper surfaces of the first convex portion 1*b* and the second convex portion 1*c* guide the protective member 12, and thus, it is possible to easily dispose the protective member 12 into the gap 32. In addition, the shapes of the first convex portion 1*b* and the second convex portion 1*c* may be formed to be inclined toward the accommodating portion 10 in a sectional view.

Hereinbefore, an example in which the protective member 12 is disposed in a part of the gap 32 between the base portion 1*a* of the heatsink 1 and the accommodating portion 10 is shown, but the protective member 12 may be disposed to fill the gap 32 between the base portion 1*a* of the heatsink 1 and the accommodating portion 10. In this case, it is possible to enhance a heat radiation property of the protective member 12, and to increase the bonding strength between the accommodating portion 10 and the heatsink 1.

Third Embodiment

Figure 6:
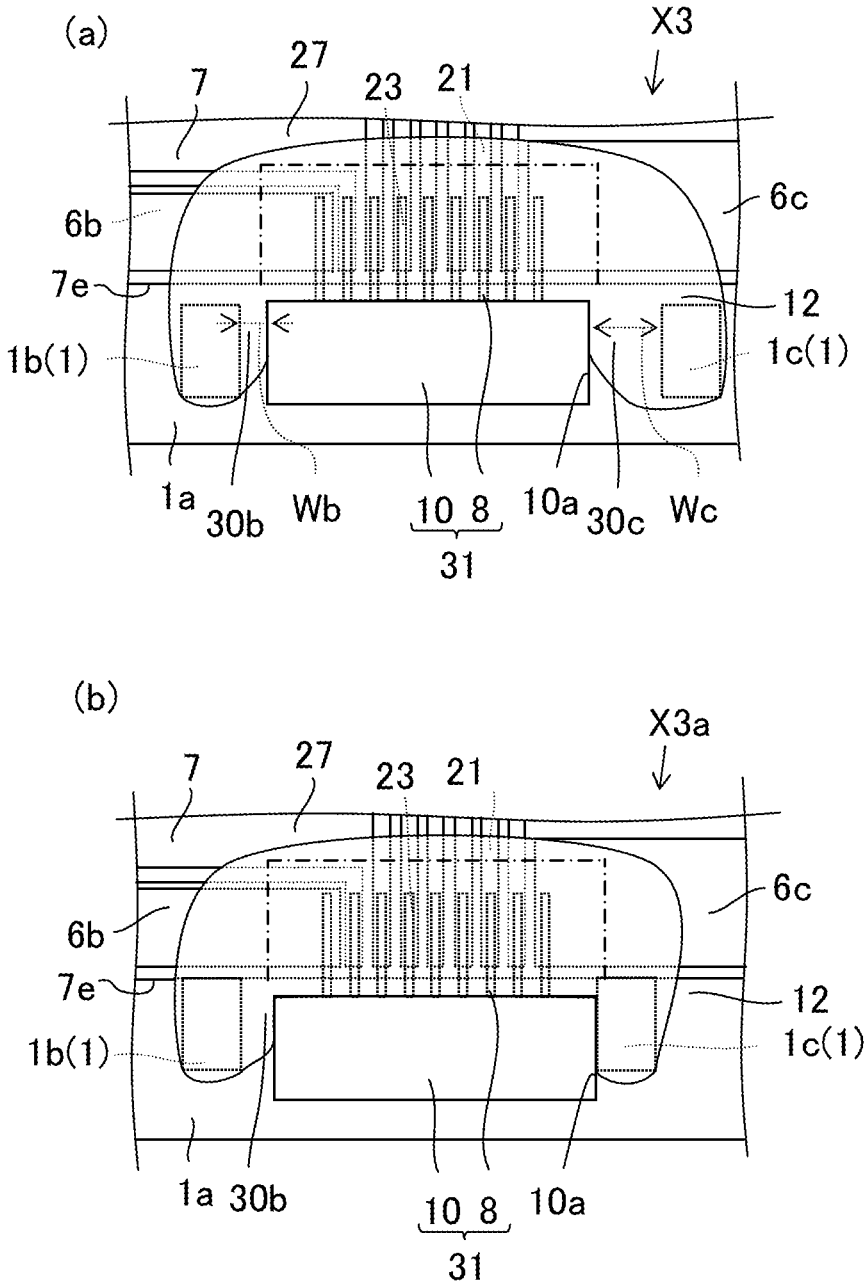
FIG. 6 is a diagram illustrating a thermal head according to a third embodiment of the invention, in which FIG. 6(*a*) is an enlarged plan view illustrating a connector and its periphery, and FIG. 6(*b*) is an enlarged plan view illustrating a connector and its periphery according to a modified example of the thermal head shown in FIG. 6(*a*)

A thermal head X3 according to a third embodiment will be described with reference to FIG. 6. The thermal head X3 has a configuration in which a distance Wb between the first convex portion 1*b* and the side surface 10*a* of the accommodating portion (hereinafter, referred to as the distance Wb) is shorter than a distance Wc between the second convex portion 1*c* and the side surface 10*a* of the accommodating portion 10 (hereinafter, referred to as the distance Wc). Further, the areas of common electrodes 6*b* and 6*c* in a plan view are different from each other.

Here, a part of the heat generated by the conductive member 23 is radiated in the common electrodes 6*b* and 6*c*. Thus, a temperature around the first convex portion 1*b* and a temperature around the second convex portion 1*c* may be different from each other due to a difference in volumes of the common electrodes 6*b* and 6*c* connected to the conductive member 23. Specifically, the temperature around the first convex portion 1*b* connected to the common electrode 6*b* having a small area may be higher than the temperature around the second convex portion 1*c* connected to the common electrode 6*c* having a large area. Further, since the electrodes on the first convex portion 1*b* side are patterned with high density compared with the electrodes on the first convex portion 1*c* side, the temperature around the first convex portion 1*b* may be higher than the temperature around the second convex portion 1*c*.

In the thermal head X3, as the distance Wb is shorter than the distance Wc, it is possible to shorten the distance from the conductive member 23 to the first convex portion 1*b* compared with the distance from the conductive member 23 to the second convex portion 1*c*. Thus, it is possible to effectively promote heat radiation on the first convex portion 1*b* side. As a result, it is possible to uniformize heat distribution in the arrangement direction of the thermal head X3, and to reduce a possibility that deformation in the arrangement direction occurs.

In this way, in the thermal head X3, by changing the distance between the accommodating portion 10 and the first convex portion 1*b* or the distance between the accommodating portion 10 and the convex portion 1*c*, it is possible to uniformize variation in temperature distribution generated due to various electrodes formed on the substrate 7.

For example, as the electrodes on the first convex portion 1*b* side are patterned with high density, when the temperature on the first convex portion 1*b* side increases, by shortening the distance between the first convex portion 1*b* and the accommodating portion 10, it is possible to efficiently radiate heat generated due to the electrodes wired with high density.

Further, with the configuration in which the distance Wb and the distance We are different from each other, the amount of the protective member 12 disposed between the first convex portion 1*b* and the accommodating portion 10, and the amount of the protective member 12 disposed between the second convex portion 1*c* and the accommodating portion 10 become different from each other. Thus, it is possible to appropriately change the bonding strengths on the first convex portion 1*b* side and on the second convex portion 1*c* side according to the amount of the protective member 12. Accordingly, it is possible to uniformize variation in an external force generated in the connector 31 due to arrangement of the connector 31 using the different bonding strengths.

A thermal head X3*a* which is a modified example of the thermal head X3 will be described with reference to FIG. 6(*b*). In the thermal head X3*a*, the area of the common electrode 6*c* on the second convex portion 1*c* side is larger than the area of the common electrode 6*b* on the first convex portion 1*b* side. Further, the second convex portion 1*c* is in contact with the side surface 10*a* of the accommodating portion 10.

Thus, a configuration in which a distance (not shown) between the second convex portion 1*c* and the accommodating portion 10 is shorter than a distance (not shown) between the first convex portion 1*b* and the accommodating portion 10 is obtained. Thus, it is possible to efficiently radiate the heat on the second convex portion 1*c* side of the protective member 12.

Further, since the second convex portion 1*c* is in contact with the side surface 10*a* of the accommodating portion 10, it is possible to shorten the distance between the conductive member 23 and the second convex portion 1*c*, to thereby efficiently perform heat radiation. Further, since the second convex portion 1*c* is in contact with the side surface 10*a* of the accommodating portion 10, it is possible to directly radiate the heat radiated in the accommodating portion 10 to the second convex portion 1*c*, to thereby enhance the heat radiation efficiency.

In addition, the first convex portion 1*b* and the second convex portion 1*c* are connected to the side surface 7*e* of the substrate 7. Thus, it is also possible to radiate the heat of the conductive member 23 through the substrate 7, to thereby further enhance the heat radiation efficiency.

Hereinbefore, an example in which the distance Wb and the distance We are changed in order to shorten the distance between the conductive member 23 to the first convex portion 1*b* or the distance between the conductive member 23 to the second convex portion 1*c* is shown, but the invention is not limited thereto. For example, the height of the first convex portion 1*b* or the second convex portion 1*c* may be changed.

Fourth Embodiment

Figure 7:
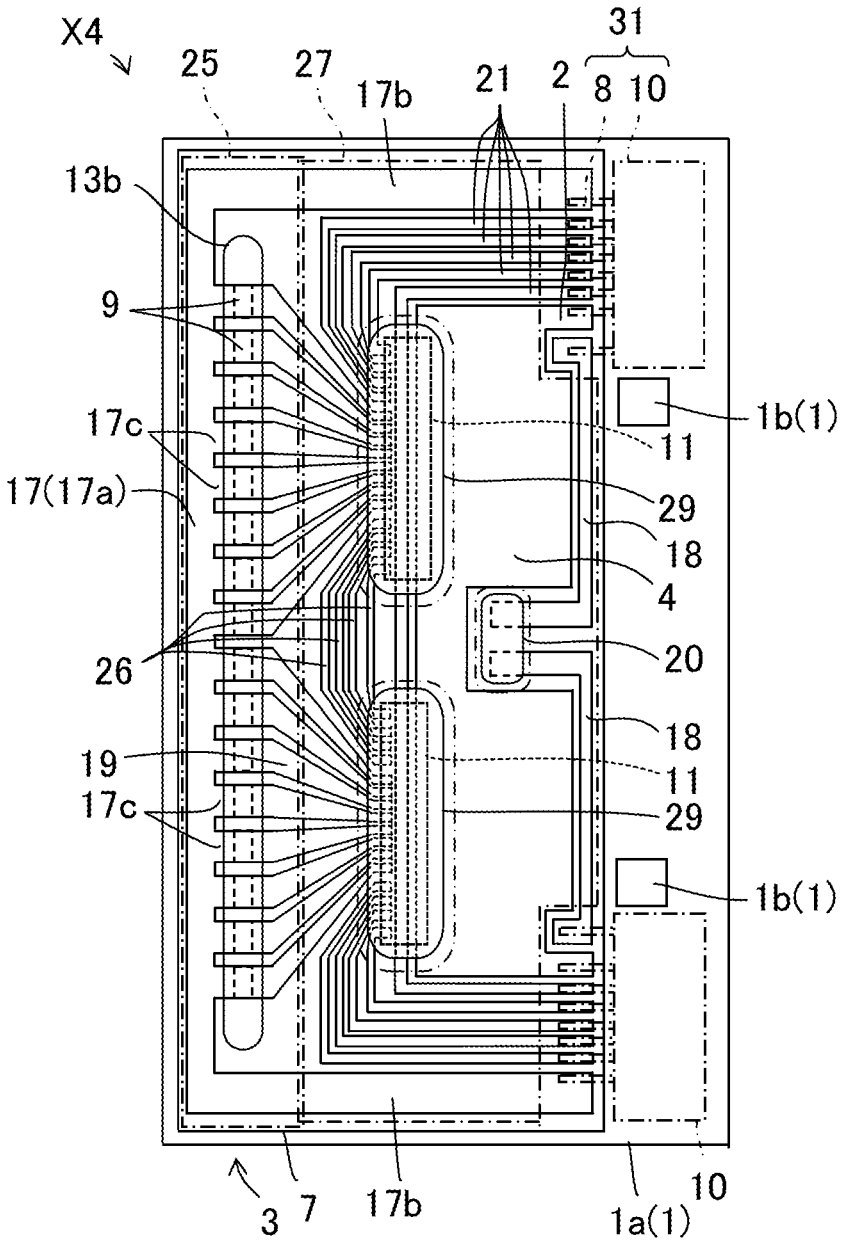
FIG. 7 is a plan view illustrating a thermal head according to a fourth embodiment of the invention.
Figure 8:
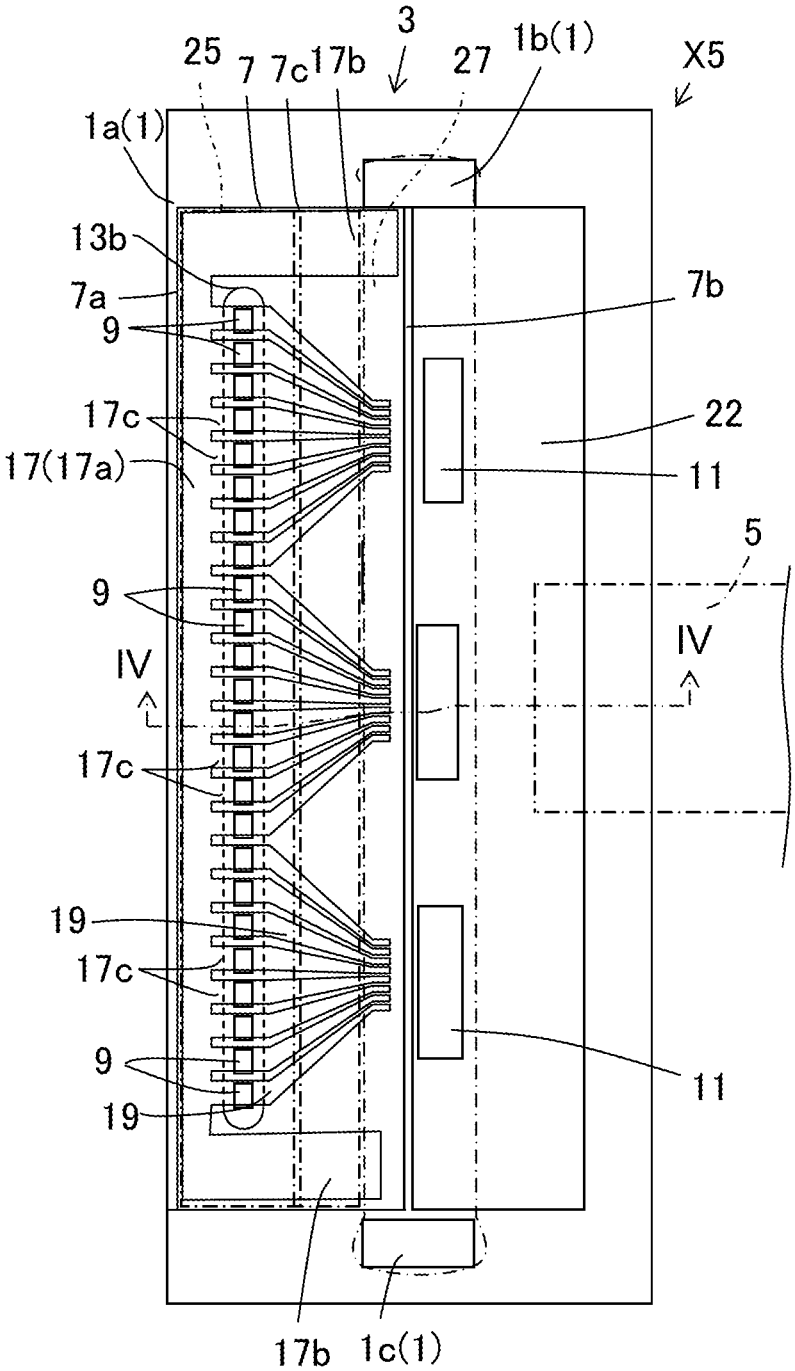
FIG. 8 is a plan view illustrating a thermal head according to a fifth embodiment of the invention.

A thermal head X4 according to a fourth embodiment will be described with reference to FIG. 7. In the thermal head X4, the connectors 31 are connected in opposite ends in the arrangement direction.

In the thermal head X4, a thermistor 20 is disposed at a central portion in the arrangement direction. The thermistor 20 is connected to connection electrodes 18, and the connection electrodes 18 are disposed so as to extend toward the opposite end portions in the arrangement direction.

In the thermal head X4, the first convex portions 1*b* are disposed adjacent to the accommodating portions 10 of the respective connectors 31. Although not shown, a protective member (not shown) is disposed from a conductive member (not shown) to upper surfaces of the first convex portions 1*b*. In this way, even in a case where only the first convex portions 1*b* are provided, it is possible to efficiently radiate heat generated by the conductive member through the protective member.

Fifth Embodiment

Figure 11:
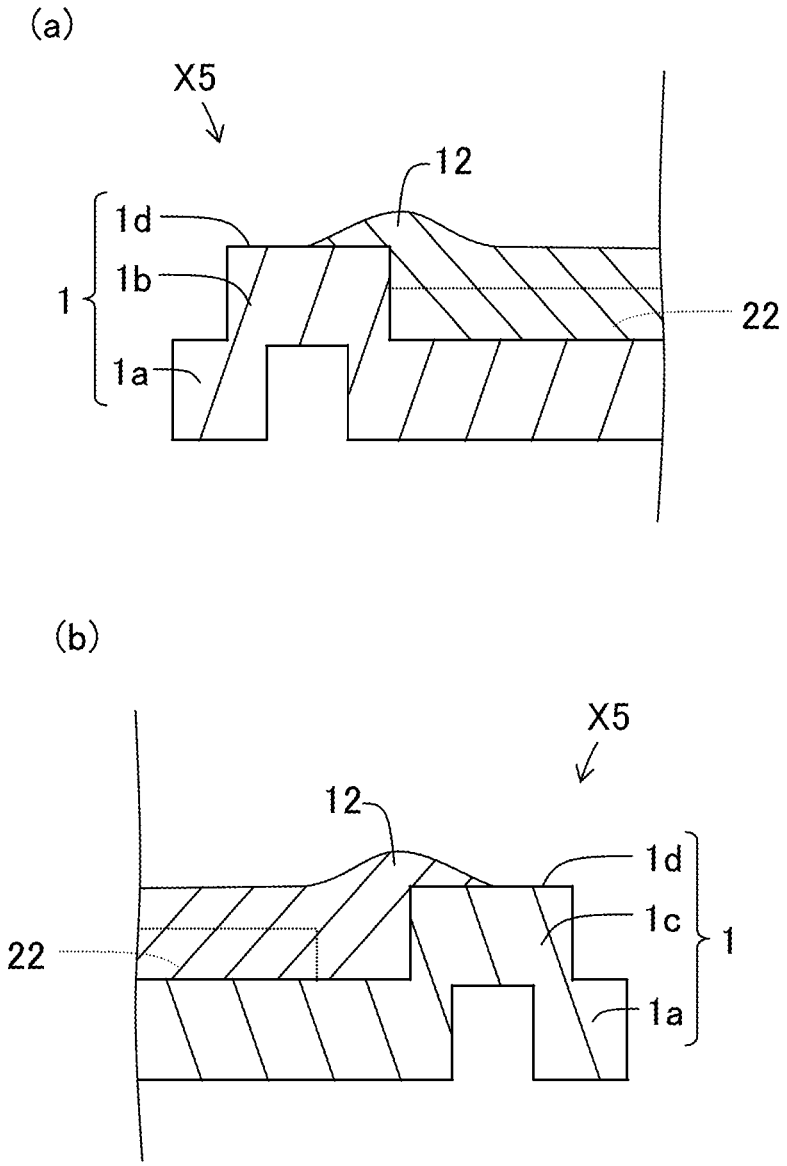
FIG. 11(*a*) is a sectional view taken along the line V-V shown in FIG. 10, and FIG. 11(*b*) is a sectional view taken along the line VI-VI shown in FIG. 10.

A thermal head X5 according to a fifth embodiment will be described with reference to FIGS. 8 to 11. In FIG. 11, the wiring board 22 is indicated by a dotted line.

The thermal head X5 includes the heatsink 1, the head base 3, the wiring board 22, and an FPC 5. The heatsink 1 includes the base portion 1*a*, the first convex portion 1*b*, and the second convex portion 1*c*. The head base 3 does not include the IC-IC connection electrode 26, the ground electrode 4, and the drive IC 11, and is different from the thermal head X1 in wiring patterns of various electrodes.

The wiring board 22 is disposed on the heatsink 1, and is disposed adjacent to the head base 3 in a sub scanning direction. The wiring board 22 is configured so that the drive ICs 11 and the wiring patterns 24 are disposed on a glass epoxy substrate or a polyimide substrate. Each drive IC 11 includes a pair of metal wires 35, in which one of the wires 35 is electrically connected to the conductive member 23 of the head base 3. Further, the other one of the wires 35 is electrically connected to the wiring pattern 24 of the wiring board 22. Thus, the wiring board 22 and the head base 3 are electrically connected to each other.

The wires 35 that electrically connects the conductive member 23 on the head base 3, and the wiring pattern 24 on the wiring board 22 are configured by a fine line made of a metallic material such as gold (Au). The wire 35 is formed to stride over a gap between the head base 3 and the wiring board 22, and electrically connects the head base 3 and the wiring board 22 by a known wire bonding method in the related art. In the present embodiment, the wire 35 is used as the conductive member.

The FPC 5 is electrically connected to the wiring board 22 through the conductive member 23. The electric connection between the FPC 5 and the wiring board 22 is performed by the above-described solder connection or AFC connection. As the FPC 5, a flexible print wiring board may be used, for example. When the flexible print wiring board is used, a reinforcing plate (not shown) formed of resin such as phenol resin, polyimide resin or glass epoxy resin may be disposed between the flexible print wiring board and the heatsink 1.

The wiring board 22 and the head base 3 are disposed in a state of being spaced from each other, and the plural drive ICs 11 are disposed on the head base 3 side of the wiring board 22. Thus, the plural wires 35 are arranged side by side in the main scanning direction. The first convex portion 1*b* and the second convex portion 1*c* of the heatsink 1 are disposed side by side with the plural wires 35 in the main scanning direction. The wiring board 22 and the head base 3 may be disposed in a state of being in contact with each other. Further, the connector 31 (see FIG. 1) may be connected to the wiring board 22.

Further, the protective member 12 is disposed so as to cover a space 34 between the wiring board 22 and the head base 3, the plural wires 35, a part of the first convex portion 1*b*, and a part of the second convex portion 1*c*.

In this way, as the wires 35 are covered by the protective member 12, it is possible to protect the wires 35. Further, since the first convex portion 1*b* and the second convex portion 1*c* are disposed in the opposite end portions in the main scanning direction, when the protective member 12 is applied onto the wires 35, it is possible to reduce a possibility that the protective member 12 flows out to protrude from the heatsink 1. Thus, it is possible to reduce a possibility that a poor appearance of the thermal head X5 is caused, and to enhance a yield rate of the thermal head X5.

Further, since the first convex portion 1*b* and the second convex portion 1*c* can suppress the outflow of the protective member 12, it is possible to reduce a possibility that the amount of the protective member 12 disposed on the wires 35 is insufficient to cause a low sealing height. Thus, it is possible to reduce a possibility that the drive ICs 11 or the wires 35 are exposed, and to obtain the thermal head X5 with enhanced reliability.

Particularly, in opposite end portions of the head base 3 and the wiring board 26 in the main scanning direction, where the protective member 12 is easily insufficient, it is possible to suppress the outflow of the protective member 12, and to reduce a possibility that the protective member 12 becomes insufficient. As a material of forming the protective member 12, the same material as that of the covering member 29 (see FIG. 2) may be used, for example.

Further, the first convex portion 1*b* is disposed in a state of being in contact with a side surface of the head base 3 and a side surface of the wiring board 22. Thus, when the head base 3 and the wiring board 22 are bonded to each other to be mounted on the heatsink 1, the first convex portion 1*b* may be used as a positioning member. Thus, it is not necessary to provide a separate positioning member, and thus, it is possible to simplify the configuration of the thermal head X5.

Further, the second convex portion 1*c* is disposed on a side opposite to the first convex portion 1*b* across the wires 35. In other words, the first convex portion 1*b* is disposed on one end portion of the head base 3 and the wiring board 22 in the main scanning direction, and the second convex portion 1*c* is disposed in the other end portion of the head base 3 and the wiring board 22 in the main scanning direction.

Thus, when the protective member 12 is applied onto the wires 35, it is possible to reduce a possibility that the protective member 12 flows out to protrude from the heatsink 1.

Further, there is achieved a structure in which the first convex portion 1*b* and the second convex portion 1*c* sandwich a bonding area between the head base 3 and the wiring board 22, which is an area where the protective member 12 is applied, in the main scanning direction. Thus, it is possible to reduce a possibility that the protective member 12 flows out, and as a result, it is not necessary to provide an extra amount of the protective member 12. Thus, it is possible to reduce the manufacturing cost of the thermal head X5.

In addition, the second convex portion 1*c* is disposed in a state of being spaced from the side surface of the head base 3 and the side surface of the wiring board 22. Thus, it is possible to accommodate the protective member 12 between the side surface of the head base 3 and the side surface of the wiring board 22, and the second convex portion 1*c*. Thus, it is possible to reduce a possibility that the protective film 12 flows out.

Further, the first convex portion 1*b* is disposed in a state of being in contact with the side surface of the head base 3 and the side surface of the wiring board 22, and the second convex portion 1*c* is disposed in a state of being spaced from the side surface of the head base 3 and the side surface of the wiring board 22.

Thus, it is possible to perform positioning using the first convex portion 1*b*, and even when the head base 3 and the wiring board 22 are thermally expanded, it is possible to alleviate stress by the protective member 12 accommodated between the side surface of the head base 3 and the side surface of the wiring board 22, and the second convex portion 1*c*. Thus, it is possible to reduce a possibility that the bonding between the head base 3 and the wiring board 22 is released. Particularly, when the head base 3 and the wiring board 22 are fixed by a hard covering member 29, useful effects are achieved.

Further, it is preferable that the heights of the first convex portion 1*b* and the second convex portion 1*c* are higher than the height of the wiring board 22. Thus, when the protective film 12 is applied, it is possible to effectively suppress the outflow of the protective member 12.

Figure 9:
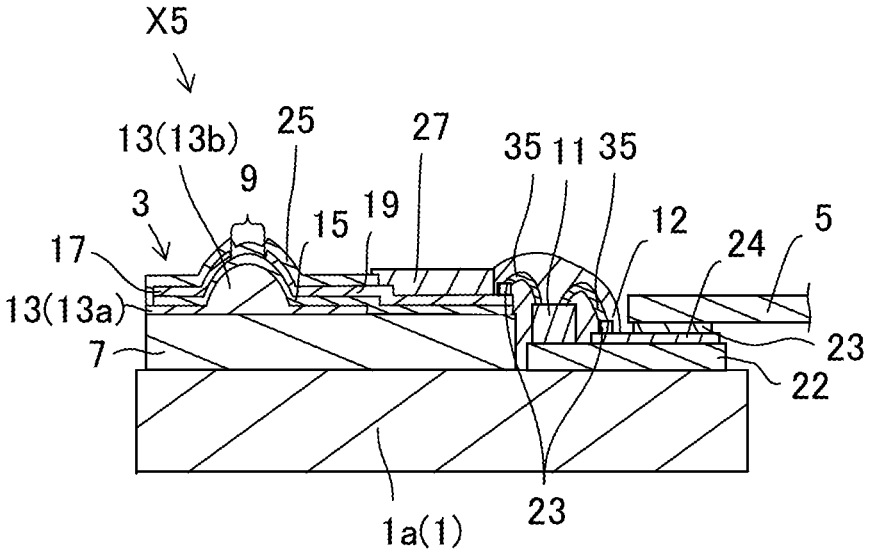
FIG. 9 is a sectional view taken along the line IV-IV shown in FIG. 8.
Figure 10:
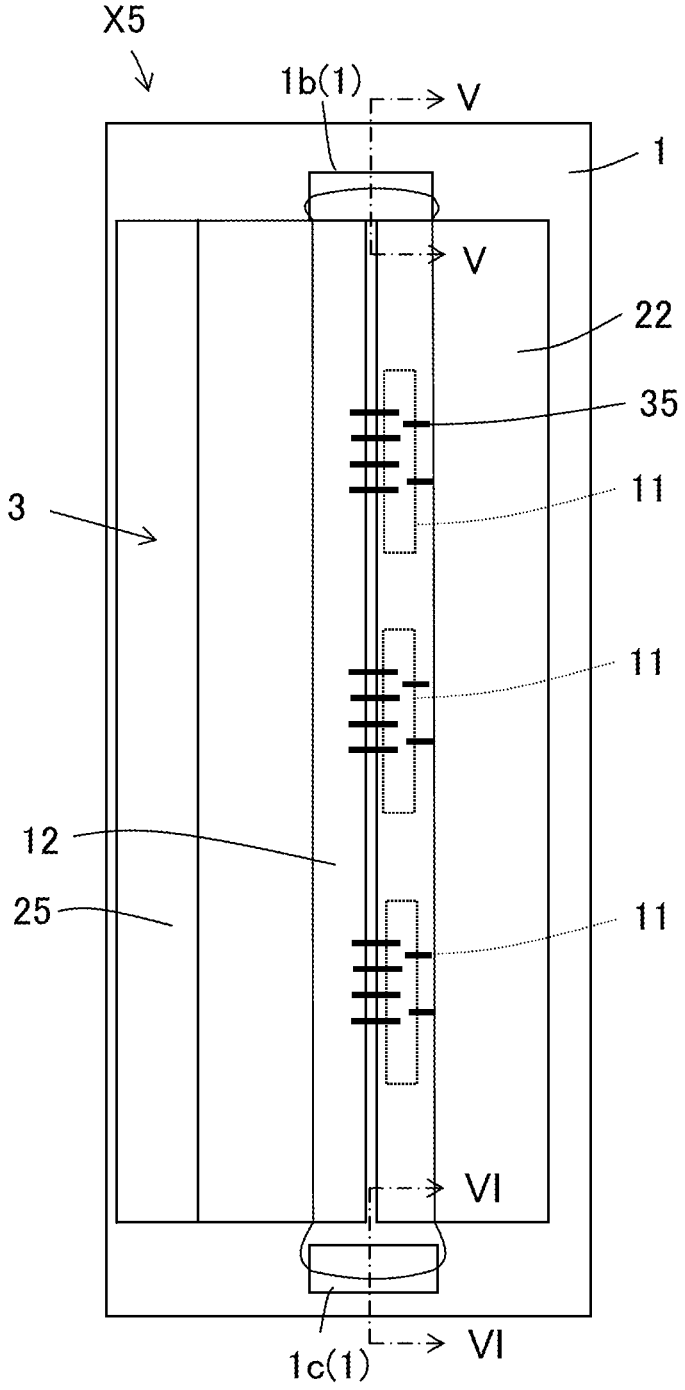
FIG. 10 is a plan view illustrating a simplified configuration of the thermal head shown in FIG. 8.

Further, it is preferable that the heights of the first convex portion 1*b* and the second convex portion 1*c* are equal to or higher than the height of the head base 3. As shown in FIG. 9, the height of the head base 3 is higher than the height of the wiring board 22. Thus, an area around the drive IC 11 which is an area where the protective member 12 is applied is surrounded by the head base 3, the first convex portion 1*b*, and the second convex portion 1*c*. Thus, it is possible to further reduce a possibility that the protective member 12 flows out. Further, it is possible to increase the amount of the protective member 12 that is present in the area surrounded by the head base 3, the first convex portion 1*b*, and the second convex potion 1*c*, to thereby increase heat capacity of the protective member 12. As a result, it is possible to efficiently radiate the heat due to the drive IC 11.

Further, it is preferable that the protective member 12 is applied up to an upper surface 1*d* of the first convex portion 1*b* and an upper surface 1*d* of the second convex portion 1*c*. Thus, it is possible to radiate the heat of the drive IC 11 transferred through the protective member 12. That is, the heat generated by the drive IC 11 is transferred to the first convex portion 1*b* and the second convex portion 1*c* through the protective member 12. The heat transferred to the first convex portion 1*b* and the second convex portion 1*c* can be efficiently radiated while passing through the inside of the heatsink 1.

Although not shown in the thermal head X5, the following configuration may be used. The first convex portion 1*b* may be spaced from the side surface of the head base 3 and the side surface of the wiring board 22. The second convex portion 1*c* may not be provided. The first convex portion 1*b* and the second convex portion 1*c* may be disposed in a state of being in contact with the side surface of the head base 3 and the side surface of the wiring board 22.

Figure 12:
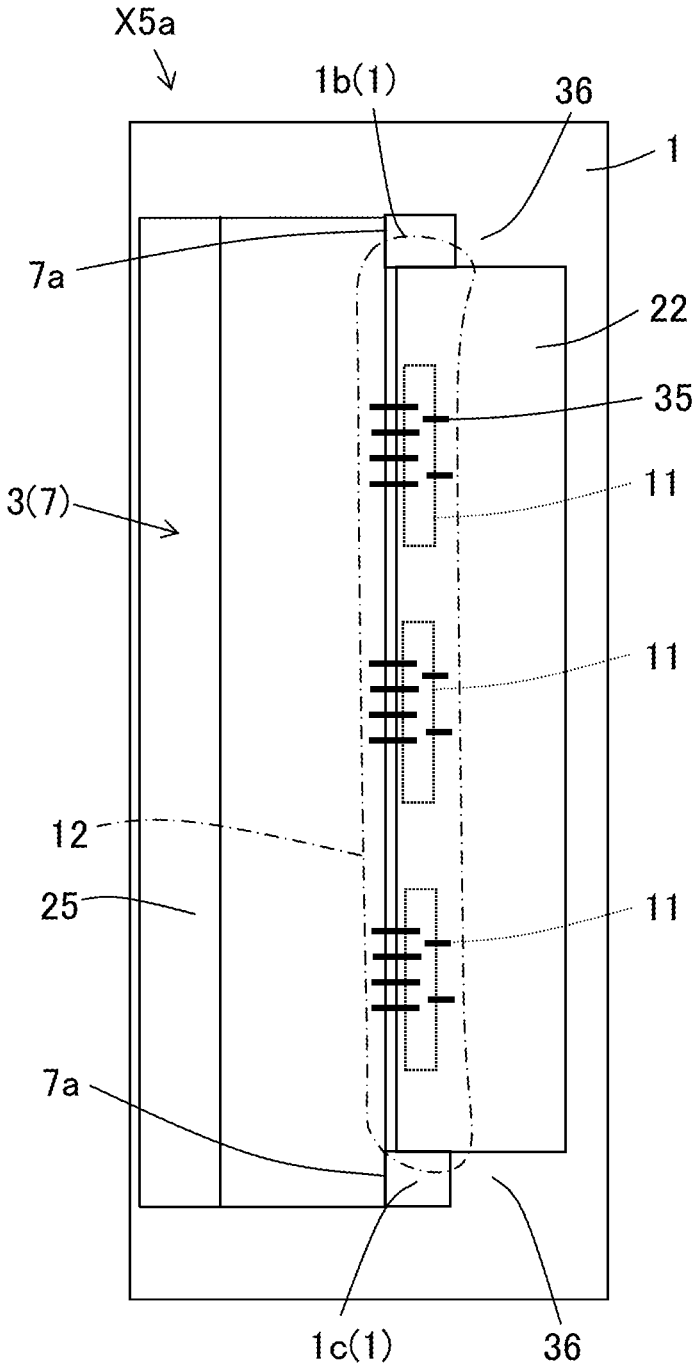
FIG. 12 a plan view illustrating a simplified configuration of a modification example of the thermal head shown in FIG. 8.

A thermal head X5*a* which is a modified example of the thermal head X5 will be described with reference to FIG. 12.

The thermal head X5*a* has a configuration in which the length of the wiring board 22 in the main scanning direction is shorter than the length of the head base 3 in the main scanning direction. Further, the first convex portion 1*b* and the second convex portion 1*c* are disposed in an area 36 formed between the head base 3 and the wiring board 22. Thus, it is possible to reduce the length of the thermal head X5*a* in the main scanning direction, to thereby achieve miniaturization in the main scanning direction.

Further, the first convex portion 1*b* and the second convex potion 1*c* are disposed in a state of being in contact with the wiring board 22. Thus, it is possible to radiate heat of the wiring board 22 to the heatsink 1 through the first convex portion 1*b* and the second convex portion 1*c*. In the thermal head X5*a* in which the drive ICs 11 are disposed on the wiring board 22, the heat is transferred from the drive ICs 11 to the wiring board 22, and the heat is radiated from the wiring board 22 to the heatsink 1 through the protective member 12. Thus, it is possible to efficiently perform heat radiation.

In addition, the first convex portion 1*b* and the second convex portion 1*c* are used for positioning of the head base 3, and fixedly support the head base 3. That is, the first convex portion 1*b* and the second convex portion 1*c* are in contact with the side surface 7*e* of the substrate 7 to fixedly support the head base 3. Thus, it is possible to fixedly support the head base 3 in opposite end portions in the main scanning direction, and to reduce a possibility that the head base 3 shifts in the sub scanning direction.

The thermal head X5*a* may be provided with only the first convex portion 1*b*, or may be provided with only the second convex portion 1*c*.

Sixth Embodiment

Figure 13:
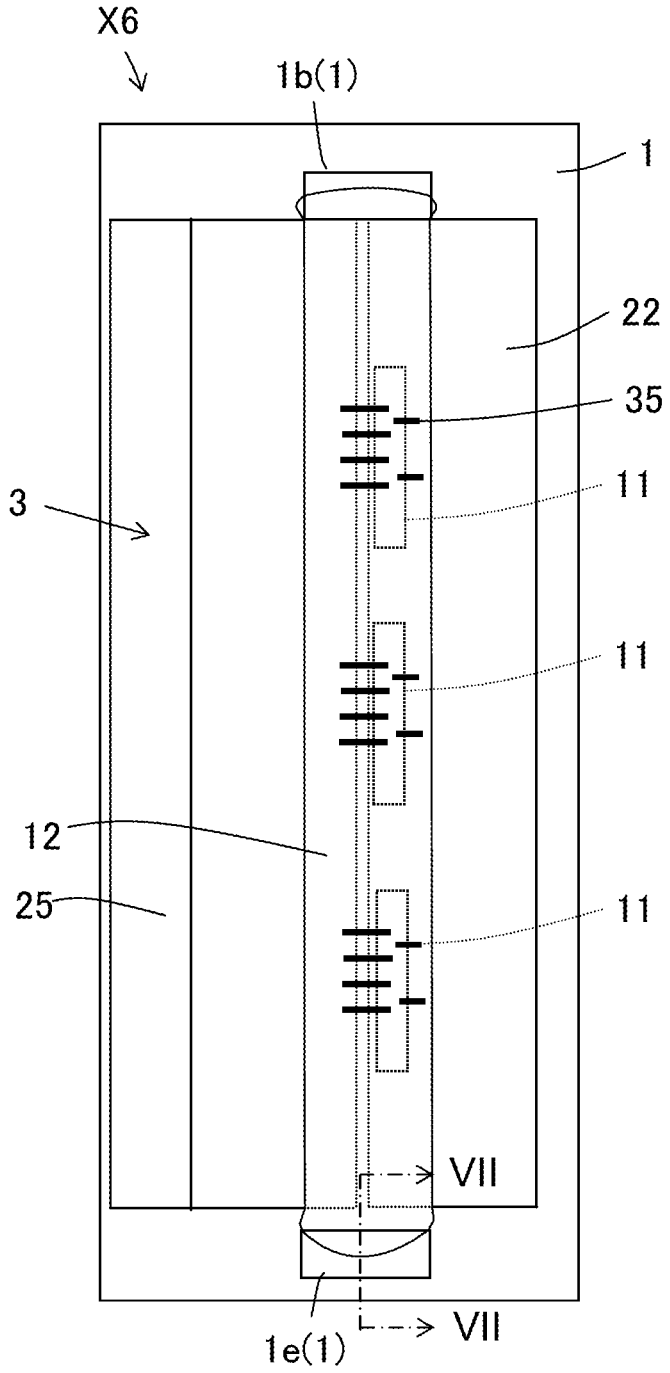
FIG. 13 is a plan view illustrating a simplified configuration of a thermal head according to a sixth embodiment of the invention.
Figure 14:
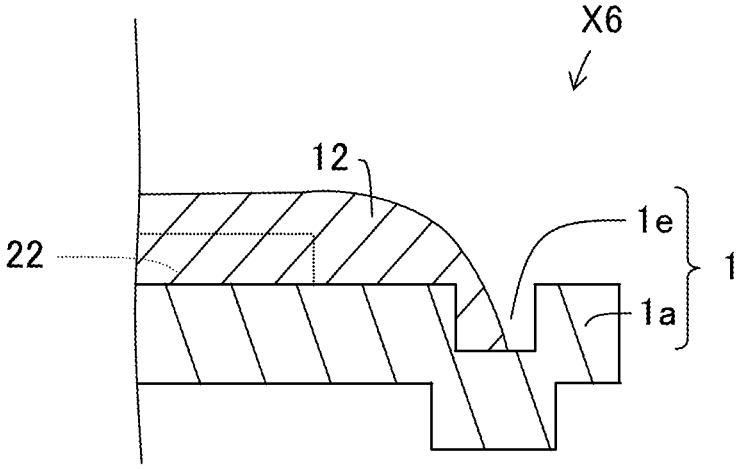
FIG. 14 is a sectional view taken along the line VII-VII shown in FIG. 13.

A thermal head X6 according to a sixth embodiment will be described with reference to FIGS. 13 and 14. The thermal head X6 is different from the thermal heads X1 to X5*a* in that a first concave portion 1*e* instead of the second convex portion 1*c* is provided. Other configurations are the same. In FIG. 14, the wiring board 22 is indicated by a dotted line.

The heatsink 1 includes the base portion 1*a*, the first convex portion 1*b*, and the first concave portion 1*e*. The first concave portion 1*e* is recessed from a front surface of the heatsink 1. Further, the first concave portion 1*e* is disposed on a side opposite to the first convex portion 1*b* in the main scanning direction. In other words, the first convex portion 1*b* is disposed in one end portion of the head base 3 and the wiring board 22 in the main scanning direction, and the first concave portion 1*e* is disposed in the other end portion of the head base 3 and the wiring board 22 in the main scanning direction.

In this way, when the first concave portion 1*e* is provided, similarly, it is possible to efficiently radiate the heat of the protective member 12 to the heatsink 1 through the first concave portion 1*e*.

Further, even though a surplus amount of the protective member 12 is generated when the protective member 12 is applied, it is possible to accommodate a part of the protective member 12 inside the first concave portion 1*e*. Thus, it is possible to reduce a possibility that a part of the protective member 12 flows out from the heatsink 1.

Here, the first concave portion 1*e* may be provided instead of the first convex portion 1*b*, and the first concave portion 1*e* and a second concave portion (not shown) may be provided instead of the first convex portion 1*b* and the second convex portion 1*c*.

Seventh Embodiment

Figure 15:
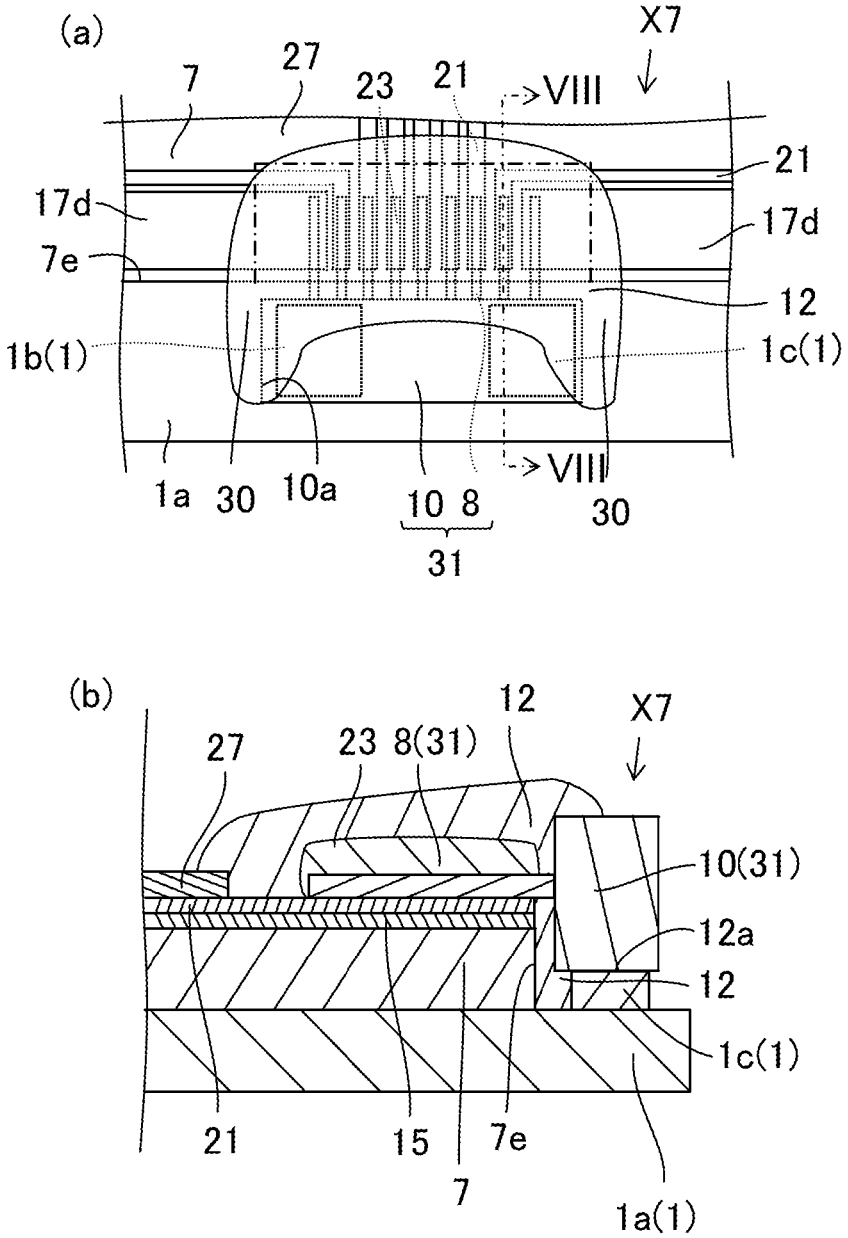
FIG. 15 is a diagram illustrating a thermal head according to a seventh embodiment of the invention, in which FIG. 15(*a*) is an enlarged plan view illustrating a connector and its periphery, and FIG. 15(*b*) is a sectional view taken along the line VIII-VIII shown in FIG. 15(*a*)

A thermal head X7 according to a seventh embodiment will be described with reference to FIG. 15.

The thermal head X7 has a configuration in which the first convex portion 1*b* and the second convex portion 1*c* are disposed under the accommodating portion 10 of the connector 31. The accommodating portion 10 is disposed on the upper surfaces of the first convex portion 1*b* and the second convex portion 1*c*. In this case, a configuration in which the first convex portion 1*b* and the second convex portion 1*c* support the connector 31 from below is obtained. As a result, even when an external force is applied to the connector 31 from above, the first convex portion 1*b* and the second convex portion 1*c* can retain the connector 31. Thus, it is possible to reduce a possibility that the connector pins 31 of the connector 31 are separated from the head base 3.

Further, the first convex portion 1*b* may be disposed in the vicinity of the bonding area between the wiring board 22 and the connector 31. In this case, similarly, the first convex portion 1*b* can efficiently radiate heat generated due to electric resistance of the wiring board 22 and the connector 31 to the heatsink 1.

Furthermore, it is preferable that the protective member 12 is disposed in an area surrounded by the first convex portion 1*b*, the second convex portion 1*c*, and the accommodating portion 10. Thus, it is possible to support the accommodating portion 10 by the first convex portion 1*b* and the second convex portion 1*c*, and to bond the accommodating portion 10 and the heatsink 1 by the protective member 12 disposed in the area surrounded by the first convex portion 1*b*, the second convex portion 1*c*, and the accommodating portion 10.

Eighth Embodiment

Figure 16:
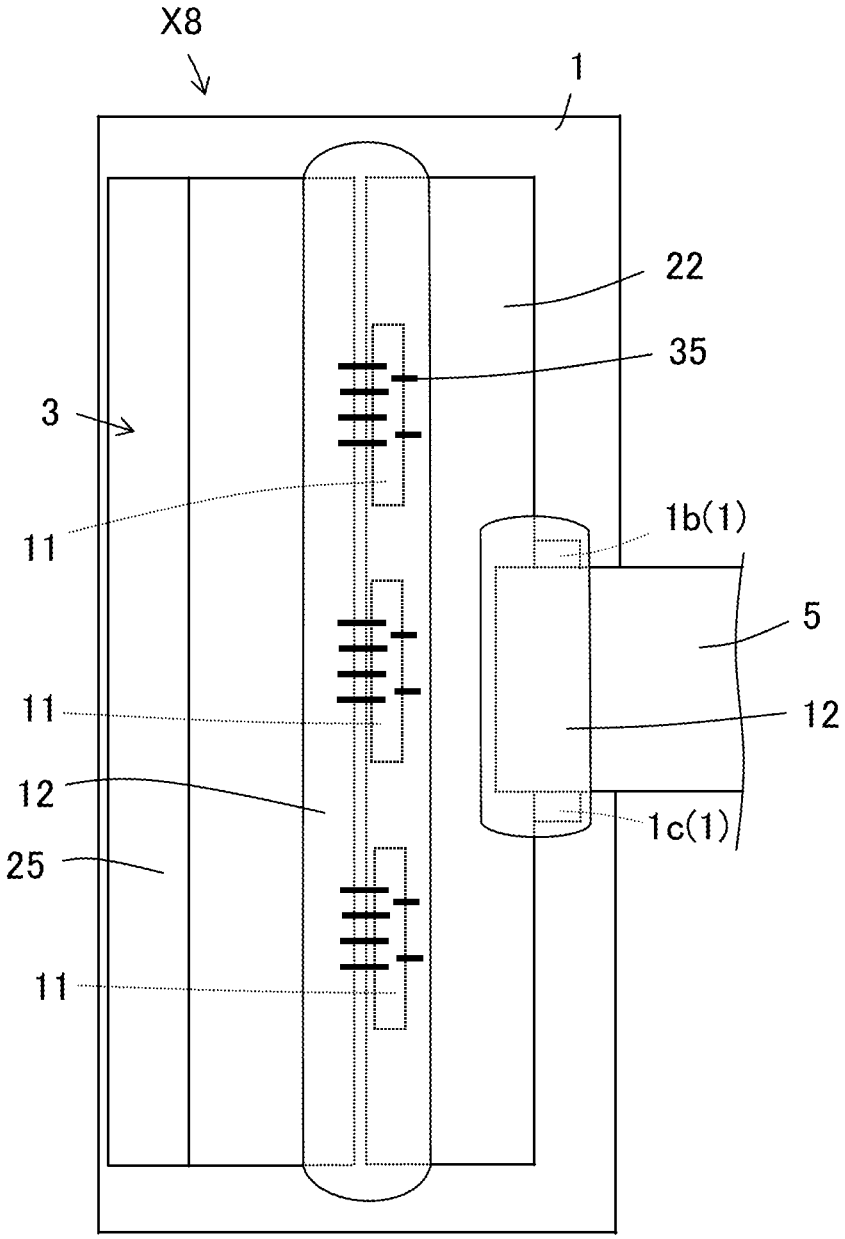
FIG. 16 is a plan view illustrating a simplified configuration of a thermal head according to an eighth embodiment of the invention.

A thermal head X8 according to an eighth embodiment will be described with reference to FIG. 16.

The thermal head X8 includes the head base 3, the wires 35, the wiring board 22, the FPC 5, and the protective member 12. The head base 3 and the wiring board 22 are electrically connected to each other by the wires 35, and the wiring board 22 is electrically connected to an external device through the FPC 5. The FPC 5 and the wiring board 22 are electrically connected to each other through the conductive members 23 (not shown), and in the present embodiment, the conductive members include the wires 35 and the conductive members 23.

Further, the heatsink 1 includes the first convex portion 1*b* and the second convex portion 1*c*, the first convex portion 1*b* and the second convex portion 1*c* are disposed adjacent to the wiring board 22. Further, the first convex portion 1*b* and the second convex portion 1*c* are disposed adjacent to the FPC 5. Thus, the wiring board 22 is positioned by the first convex portion 1*b* and the second convex portion 1*c*. Further, the FPC 5 is positioned by the first convex portion 1*b* and the second convex portion 1*c*.

The protective member 12 is disposed so as to cover the wires 35. Further, the protective member 12 that covers the wires 35 is in contact with the heatsink 1. Further, the protective member 12 is disposed so as to cover an end portion of the FPC 5, and a part of the protective member 12 is in contact with the first convex portion 1*b* and the second convex portion 1*c*.

In this way, the protective members 12 may be disposed as separated members so as to cover the wires 35 and the conductive members 23, and a part of the protective member 12 may be in contact with the heatsink 1. In this case, similarly, it is possible to efficiently radiate heat generated by the wires 35 or heat generated by the conductive members 23 through the respective protective members 12.

Hereinbefore, the embodiments of the invention have been described, but the invention is not limited to the above embodiments, and various modifications are possible without departing from the scope of the invention. For example, the thermal printer Z1 using the thermal head X1 according to the first embodiment is shown, but the invention is not limited thereto, and the thermal heads X2 to X8 may be used in the thermal printer Z1. Further, the thermal heads X1 to X8 according to the plural embodiments may be combined.

Further, in the thermal head X1, the protruding portion 13*b* is formed in the heat storage layer 13 and the electrical resistance layer 15 is formed on the protruding portion 13*b*, but the invention is not limited thereto. For example, the protruding portion 13*b* may not be formed in the heat storage layer 13, and instead, the heat generating portion 9 of the electrical resistance layer 15 may be disposed on the base portion 13*a* of the heat storage layer 13. Further, the heat storage layer 13 may be disposed over an overall area of the upper surface of the substrate 7.

In addition, in the thermal head X1, the common electrode 17 and the individual electrodes 19 are formed on the electrical resistance layer 15, but as long as both the common electrode 17 and the individual electrodes 19 are connected to the heat generating portions 9 (electric resistance bodies), the invention is not limited thereto. For example, the heat generating portion 9 may be formed by forming the common electrode 17 and the individual electrodes 19 on the heat storage layer 13 and forming the electrical resistance layer 15 only in an area between the common electrode 17 and the individual electrodes 19.

Furthermore, an example of a thin film head in which the heat generating portions 9 are formed to be thin as the electrical resistance layer 15 is formed to be thin is shown, but the invention is not limited thereto. For example, the invention may be applied to a thick film head in which the thick-film heat generating portions 9 are provided by forming the electrical resistance layer 15 to be thick after various electrodes are patterned. In addition, the present technique may be applied to an edge head in which the heat generating portions 9 are formed on an edge surface of the substrate 7.

REFERENCE SIGNS LIST

X1-X8: Thermal head
Z1: Thermal printer
1: Heatsink
1*a*: Base portion
1*b*: First convex portion
1*c*: Second convex portion
1*d*: Upper surface
1*e*: First concave portion
2: Connection terminal
3: Head base
4: Ground electrode
5: FPC
7: Substrate
8: Connector pin
9: Heat generating portion
10: Accommodating portion
11: Drive IC
12: Protective member
13: Heat storage layer
15: Electrical resistance layer
17: Common electrode
19: Individual electrode
21: IC-connector connection electrode
23: Conductive member
25: Protective layer
26: IC-IC connection electrode
27: Cover layer
29: Covering member

The invention claimed is:

1. A thermal head, comprising:
a substrate;
a plurality of heat generating portions disposed on the substrate;
an electrode which is disposed on the substrate and is electrically connected to the heat generating portions;
a connector comprising a connector pin and an accommodating portion which accommodates the connector pin,
a conductive member which electrically connects the electrode and the connector pin;
a protective member which is in contact with the conductive member and protects the conductive member; and
a heatsink disposed under the substrate,
wherein the accommodating portion is disposed above the heatsink to be spaced from the heatsink at a predetermined interval,
the protective member is disposed between the accommodating portion and the heatsink, and
the protective member is in contact with the accommodating portion and the heatsink.

2. The thermal head according to claim 1,
wherein the heatsink comprises a first convex portion which protrudes upwardly, and
the protective member is in contact with the first convex portion.

3. The thermal head according to claim 2,
wherein the first convex portion and the accommodating portion are disposed adjacent to each other, and
the protective member is disposed between the first convex portion and the accommodating portion.

4. The thermal head according to claim 2,
wherein the heatsink comprises a second convex portion which protrudes upwardly,
the accommodating portion is disposed between the first convex portion and the second convex portion, and
the second convex portion and the accommodating portion are in contact with each other.

5. The thermal head according to claim 4,
wherein a distance between the first convex portion and the accommodating portion is different from a distance between the second convex portion and the accommodating portion.

6. The thermal head according to claim 4,
wherein the substrate and at least one of the first convex portion and the second convex portion are in contact with each other.

7. The thermal head according to claim 2,
wherein the heatsink comprises a second convex portion which protrudes upwardly,
the accommodating portion is disposed between the first convex portion and the second convex portion, and
the protective member is also disposed between the second convex portion and the accommodating portion.

8. The thermal head according to claim 2, further comprising:
a wiring board which is disposed adjacent to the substrate on the heatsink and is electrically connected to the substrate,
wherein the wiring board comprises a plurality of connection members in a main scanning direction, in which the plurality of connection members are covered with the protective member, and
the first convex portion is disposed side by side with the connection members in the main scanning direction.

9. The thermal head according to claim 8,
wherein the first convex portion is disposed in a state of being in contact with the substrate.

10. The thermal head according to claim 8,
wherein the heatsink comprises a second convex portion which protrudes upwardly, and
the second convex portion is disposed on a side opposite to the first convex portion across the connection members.

11. The thermal head according to claim 10,
wherein the second convex portion is disposed in a state of being spaced from the substrate.

12. The thermal head according to claim 8,
wherein the heatsink comprises a first concave portion recessed from a surface of the heatsink, and
the first concave portion is disposed on a side opposite to the first convex portion across the connection members.

13. The thermal head according to claim 1,
wherein part of the protective member which part is disposed between the accommodating portion and the heatsink includes an upper end which is in contact with the accommodating portion and a lower end which is in contact with the heatsink, and
in a plan view of the substrate, an edge of the lower end is disposed more distantly from the substrate than an edge of the upper end.

14. A thermal printer, comprising:
the thermal head according to claim 1;
a conveyance mechanism which conveys a recording medium onto the heat generating portions; and
a platen roller which presses the recording medium on the heat generating portions.

15. A thermal head, comprising:
a substrate;
a plurality of heat generating portions disposed on the substrate;
an electrode which is disposed on the substrate and is electrically connected to the heat generating portions;
a wiring board which is disposed adjacent to the substrate;
a conductive member which electrically connects the electrode and the wiring board;
a protective member which is in contact with the conductive member and protects the conductive member; and
a heatsink disposed under the substrate and the wiring board,
the protective member being in contact with the heatsink.

16. The thermal head according to claim 15,
wherein the heatsink comprises a first convex portion which protrudes upwardly,
a plurality of the conductive members are disposed in a main scanning direction, and
the first convex portion is disposed side by side with the plurality of conductive members in the main scanning direction.

17. The thermal head according to claim 16,
wherein the heatsink comprises a second convex portion which protrudes upwardly, and
the second convex portion is disposed on a side opposite to the first convex portion across the plurality of conductive members.

18. The thermal head according to claim 16,
wherein the heatsink comprises a first concave portion recessed from a front surface of the heatsink, and
the first concave portion is disposed on a side opposite to the first convex portion across the plurality of conductive members.

19. A thermal printer, comprising:
the thermal head according to claim 15;
a conveyance mechanism which conveys a recording medium onto the heat generating portions; and
a platen roller which presses the recording medium on the heat generating portions.

20. A thermal head, comprising:
a substrate;
a plurality of heat generating portions disposed on the substrate;
an electrode which is disposed on the substrate and is electrically connected to the heat generating portions;
a connector comprising a connector pin and an accommodating portion which accommodates the connector pin,
a conductive member which electrically connects the electrode and the connector pin;
a protective member which is in contact with the conductive member and protects the conductive member; and
a heatsink disposed under the substrate,
wherein the heatsink comprises a first convex portion which protrudes upwardly,
the protective member is in contact with the first convex portion,
the first convex portion and the accommodating portion are disposed adjacent to each other, and
the protective member is disposed between the first convex portion and the accommodating portion.

* * * * *